US009069334B2

(12) United States Patent
Imamura et al.

(10) Patent No.: US 9,069,334 B2
(45) Date of Patent: Jun. 30, 2015

(54) RADIO CLOCK

(71) Applicant: SEIKO CLOCK INC., Tokyo (JP)

(72) Inventors: Miyuki Imamura, Tokyo (JP); Motohiro Tako, Tokyo (JP); Takayuki Kanaizumi, Tokyo (JP)

(73) Assignee: SEIKO CLOCK INC., Tokyo (JP)

( * ) Notice: Subject to any disclaimer, the term of this patent is extended or adjusted under 35 U.S.C. 154(b) by 0 days.

(21) Appl. No.: 14/313,162

(22) Filed: Jun. 24, 2014

(65) Prior Publication Data

US 2015/0003212 A1 Jan. 1, 2015

(30) Foreign Application Priority Data

Jun. 27, 2013 (JP) ..... 2013-135550

(51) Int. Cl.
*G04R 20/02* (2013.01)
*G04R 20/04* (2013.01)

(52) U.S. Cl.
CPC ..... *G04R 20/02* (2013.01); *G04R 20/04* (2013.01)

(58) Field of Classification Search
CPC ..... G04R 20/02; G04R 20/04
USPC ..... 368/47
See application file for complete search history.

(56) References Cited

U.S. PATENT DOCUMENTS

| | | | | |
|---|---|---|---|---|
| 8,520,473 | B2 * | 8/2013 | Honda | 368/14 |
| 8,533,516 | B2 * | 9/2013 | Eliezer et al. | 713/400 |
| 8,897,097 | B2 * | 11/2014 | Baba et al. | 368/47 |
| 2010/0097896 | A1 * | 4/2010 | Baba | 368/47 |
| 2012/0269042 | A1 * | 10/2012 | Honda | 368/47 |

FOREIGN PATENT DOCUMENTS

| | | | |
|---|---|---|---|
| JP | H10-82875 | | 3/1998 |
| JP | 2011-122891 | A1 | 6/2011 |
| JP | 2011-226813 | A1 | 11/2011 |
| JP | 2011-226933 | A1 | 11/2011 |

* cited by examiner

*Primary Examiner* — Vit W Miska
(74) *Attorney, Agent, or Firm* — Kratz, Quintos & Hanson, LLP

(57) ABSTRACT

A radio clock including: an antenna configured to receive a satellite signal transmitted from GPS satellite; a receiving unit configured to perform a receiving process to acquire information contained in the satellite signal received by the antenna within a predetermine upper limit period; and a control unit configured to change the number of receiving processes to be performed in a predetermined period and change the upper limit period in accordance with a total sum of durations of the receiving processes performed in the predetermined period.

5 Claims, 8 Drawing Sheets

FIG. 4

| SUM_R | RECEPTION FREQUENCY |
|---|---|
| LESS THAN 5 MINUTES | 4 TIMES/DAY |
| 5 MINUTES OR MORE, LESS THAN 15 MINUTES | 1 TIME/DAY |
| 15 MINUTES OR MORE, LESS THAN 25 MINUTES | 1 TIME/2 DAYS |
| 25 MINUTES OR MORE, 35 MINUTES OR LESS | 1 TIME/3 DAYS |

FIG. 5

| SUM_T | TIME-OUT PERIOD | | | |
|---|---|---|---|---|
| | 4 TIMES /DAY | 1 TIMES /DAY | 1 TIMES /2 DAY | 1 TIMES /3 DAY |
| LESS THAN 5 MINUTES | 3 MINUTES | 15 MINUTES | 25 MINUTES | 35 MINUTES |
| 5 TO 10 MINUTES | 10 MINUTES | 15 MINUTES | 25 MINUTES | 35 MINUTES |
| 10 TO 15 MINUTES | | | 25 MINUTES | 35 MINUTES |
| 15 TO 35 MINUTES | | | | 35 MINUTES |

RADIO CLOCK

CROSS-REFERENCE TO RELATED APPLICATION

This application is based upon and claims priority to Japanese Patent Application No. 2013-135550 filed on Jun. 27, 2013, subject matter of this patent document is incorporated by reference herein in its entirety.

BACKGROUND (i) Technical Field

The present invention relates to radio clocks.

(ii) Related Art

A radio clock receives satellite signals transmitted from GPS (Global Positioning System) satellites, and corrects the time of the internal clock based on the time information contained in the received satellite signals. By doing so, the radio clock displays highly-accurate time. However, the power consumption by the reception module that extracts time information and the like from satellite signals received from GPS satellites is large. Therefore, the issue is how long the life of a battery-driven radio clock can be maintained. Japanese Unexamined Patent Application Publication Nos. 2011-226813, 2011-226933, and 10-82875 disclose radio clocks that consume less power and have longer operating times.

However, Japanese Unexamined Patent Application Publication Nos. 2011-226813, 2011-226933, and 10-82875 do not disclose a technique for optimizing the frequency of satellite signal reception and the duration of a receiving process in accordance with the environment to receive satellite signals.

SUMMARY

It is therefore an object to provide a radio clock capable of suitably setting a satellite signal reception frequency and duration of a receiving process in accordance with environment to receive satellite signals.

According to an aspect of the present invention, there is provided a radio clock including: an antenna configured to receive a satellite signal transmitted from a GPS satellite; a receiving unit configured to perform a receiving process to acquire information contained in the satellite signal received by the antenna within a predetermined upper limit period; and a control unit configured to change the number of receiving processes to be performed in a predetermined period and change the upper limit period in accordance with a total sum of durations of the receiving processes performed in the predetermined period.

BRIEF DESCRIPTION OF THE DRAWINGS

FIG. 4 is a diagram showing examples of reception frequencies to be set in accordance with the total sum of reception durations;

FIG. 5 is a diagram showing examples of time-out periods to be set in accordance with the value of SUM_T;

DETAILED DESCRIPTION

Figure 1:
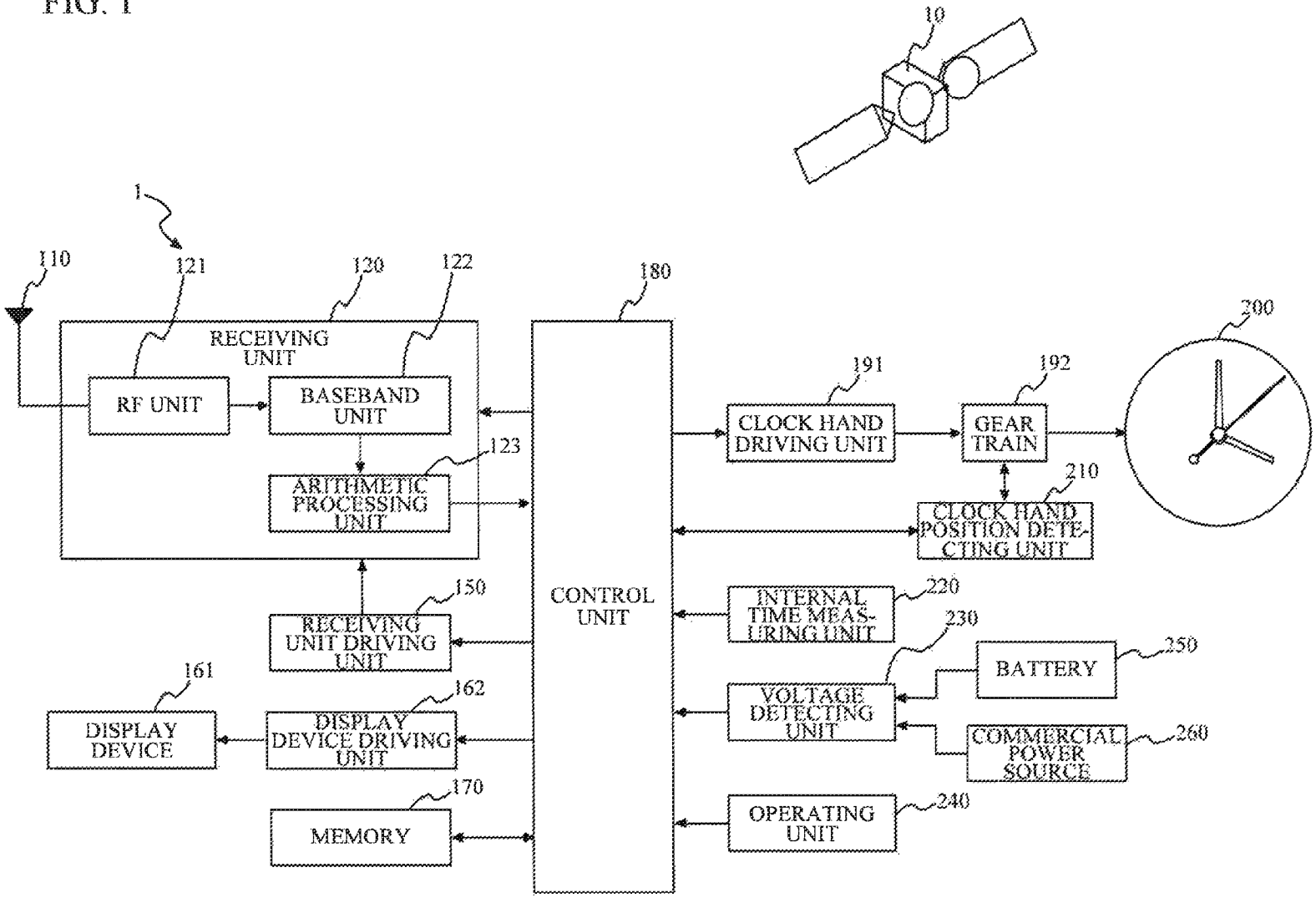
FIG. 1 is a diagram showing an example of the hardware of a radio clock.

Referring first to FIG. 1, the structure of this embodiment is described. A radio clock 1 of this embodiment includes a GPS antenna 110, a receiving unit 120, a receiving unit driving unit 150, a display device 161, a display device driving unit 162, a memory 170, a control unit 180, a clock hand driving unit 191, a gear train 192, a time display unit 200, a clock hand position detecting unit 210, an internal tine measuring unit 220, a voltage detecting unit 230, and an operating unit 240.

The GPS antenna 110 is an antenna that receives satellite signals transmitted from GPS satellites 10. The GPS antenna 110 outputs the received satellite signals to the receiving unit 120. In FIG. 1, only one GPS satellite 10 is shown for simplicity.

The receiving unit 120 includes a RE (Radio Frequency) unit 121, a baseband unit 122, and an arithmetic processing unit 123. The receiving unit 120 performs a receiving process to acquire, from a satellite signal received by the GPS antenna 110, information such as time information superimposed on the satellite signal.

The RF unit 121 generates an intermediate frequency signal (hereinafter referred to as the IF signal) by performing downsampling on the received satellite signal, and then outputs the IF signal to the baseband unit 122. The baseband unit 122 performs correlation processing on the IF signal and a replica signal having the diffusion code of the satellite signal, and performs a process to acquire and track a desired satellite signal based on the result of the correlation processing. The baseband unit 122 outputs the result of the correlation processing to the arithmetic processing unit 123. The arithmetic processing unit 123 demodulates a navigation message by mixing the IF signal and the replica signal having the same pattern as the diffusion code of the GPS satellite 10 acquired by the baseband unit 122. By doing so, the arithmetic processing unit 123 acquires information such as the time information and the date information contained in the navigation message.

Under the control of the control unit 180, the receiving unit driving unit 150 causes the receiving unit 120 to perform a receiving process or stops the receiving process of the receiving unit 120.

The display device 161 is a device such as an LCD (a liquid crystal monitor), and displays information such as the date and the day of the week on a display screen. The display device driving unit 162 drives the display device 161 to display information on the display screen of the display device 161.

The memory 170 stores the program to be used by the control unit 180 to perform control, information received from the GPS satellites 10, the reception frequency setting table shown in FIG. 4 and the time-out setting table shown in FIG. 5.

The control unit 180 controls the respective units in accordance with the program recorded in the memory 170.

The clock hand driving unit 191 includes a step motor and the like (not shown). Under the control of the control unit 180, the clock hand driving unit 191 drives the gear train 192, and corrects the displayed time indicated by the clock hands (the hour hand, the minute hand, and the second hand) of the time display unit 200.

The clock hand position detecting unit 210 detects the position of the gear train 192, to detect the positions of the respective clock hands. A method of detecting the positions of clock hands with the clock hand position detecting unit 210 is disclosed in Japanese Unexamined Patent Application Publication No. 2011-122891, for example.

The internal time measuring unit 220 is a time measuring unit that measures the current time in the radio clock 1, and includes a year counter, a month counter, a day counter, an hour counter, a minute counter, and a second counter, for example.

Figure 2:
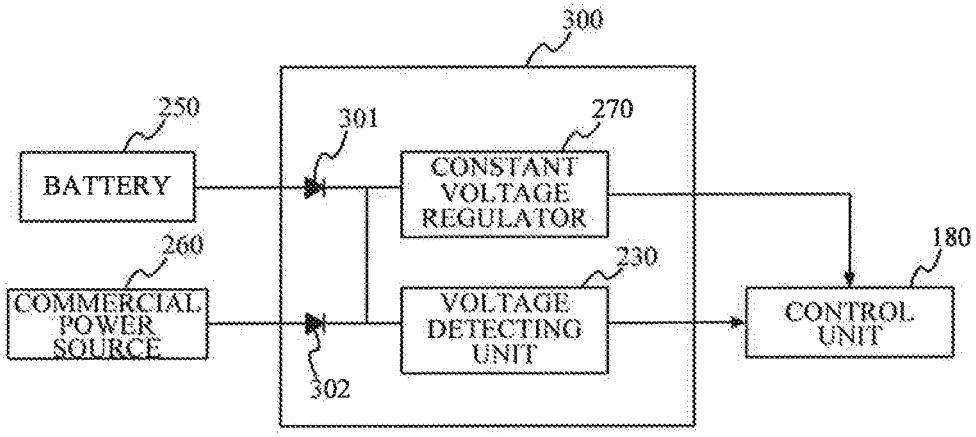
FIG. 2 is a diagram showing an example of connection structure for a battery and a commercial power source.

The voltage detecting unit 230 detects connection of a commercial power source 260 to the radio clock 1, or disconnection of the commercial power source 260 from the radio clock 1. Referring now to FIG. 2, the voltage detecting unit 230 is described in detail. FIG. 2 shows an example structure of the power source connecting unit 300 of the radio clock 1. The power source connecting unit 300 includes a constant voltage regulator 270, the voltage detecting unit 230, and diodes 301 and 302. A battery 250 is connected to the constant voltage regulator 270 and the voltage detecting unit 230 via the diode 301. In a case where the commercial power source 260 is connected to the power source connecting unit 300, the commercial power source 260 is connected to the constant voltage regulator 270 and the voltage detecting unit 230 via the diode 302.

When receiving a power supply from the battery 250, the constant voltage regulator 270 turns a voltage supplied from the battery 250 into a constant voltage (3.3 V, for example), and outputs the constant voltage to a power supply destination such as the control unit 180. In a case where the commercial power source 260 is connected to the power source connecting unit 300, the constant voltage regulator 270 turns power supplied from the commercial power source 260 into a constant voltage (3.3 V, for example), and outputs the constant voltage to a power supply destination such as the control unit 180.

The voltage detecting unit 230 detects connection of the commercial power source 260 to the radio clock 1, or disconnection of the commercial power source 260 from the radio clock 1. The voltage detecting unit 230 then notifies the control unit 180 of a result of the detection. When the commercial power source 260 is connected to the power source connecting unit 300, the voltage that is input to the voltage detecting unit 230 is higher than 5 V. When the input voltage is higher than 5 V, the voltage detecting unit 230 switches the level of the signal to be output to the control unit 180 from the high level to the low level, for example. Likewise, when the voltage to be input to the voltage detecting unit 230 is lower than 5 V, the voltage detecting unit 230 switches the level of the signal to be output to the control unit 180 from the low level to the high level. Based on a change in the signal level of a signal that is input from the voltage detecting unit 230, the control unit 180 determines whether the commercial power source 260 is connected to the radio clock 1.

A method of detecting connection of the commercial power source 260 to the radio clock 1 does not necessarily involve only the voltage detecting unit 230. For example, connection to the commercial power source 260 may be detected when an insertion plug of the radio clock 1 is connected to a plug socket (not shown).

The operating unit 240 receives an input of operation information such as alarm settings.

The control unit 180 sets a reception start time at which the receiving unit 120 is made to start a receiving process, the number of times the receiving unit 120 is made to perform a receiving process in one day (24 hours) (hereinafter referred to as the reception frequency), and an upper limit period of a receiving process (hereinafter referred to as the time-out period). The control unit 180 sets slots, and then sets reception start times, reception frequencies, and time-out periods. The slots determine the receiving processes of the receiving unit 120, and the receiving unit 120 performs a receiving process in each of the set slots. A reception start time and a time-out period are set in each slot, and a reception frequency is set by determining the number of slots. For example, when the number of slots is four, the receiving unit 120 performs a receiving process on a satellite signal from a GPS satellite 10 four times in one day. A reception start time and a time-out period are set in each slot. For example, reception start times are set in the respective slots: 04:00 in slot 1, 10:00 in slot 2, 16:00 in slot 3, and 22:00 in slot 4. A time-out period is an upper limit period from the time when the receiving unit 120 starts a receiving process to the time when the receiving process of the receiving unit 120 is determined to have failed and is ended. Example cases of reception failures include a case where any satellite signal is not received, a case where a satellite signal is received but any data is not extracted from the received satellite signal, and the like. As for the time-out periods, the same periods are set in the respective slots.

The control unit 180 also includes a satellite's orbital cycle counter (not shown). This satellite's orbital cycle counter is a counter that increments the count value by 1 every four minutes in synchronization with the time measured by the internal time measuring unit 220. After counting to 359, the satellite's orbital cycle counter clears the count value. That is, the satellite's orbital cycle counter counts from 0 to 359 every 23 hours 56 minutes. This is because one orbital cycle of each GPS satellite 10 with respect to the earth is approximately 23 hours 56 minutes. Every time the satellite's orbital cycle counter counts to 359, the control unit 180 sets the reception start time forward four minutes in one day in each slot.

Also, when the voltage detecting unit 230 detects connection of the commercial power source 260 to the radio clock 1, the control unit 180 performs control so as to make the number of slots larger and the time-out period longer than in a case where the radio clock 1 is driven by the battery 250. As the commercial power source 260 is connected to the radio clock 1, the operation mode is switched from an operation mode for reducing power consumption to an operation mode for increasing precision of satellite signal reception.

Every time a receiving process comes to an end in a set slot, the control unit 180 calculates the total sum (hereinafter denoted by SUM_R) of the reception durations in the respective slots in a predetermined period from the end of the receiving process. A reception duration is a period that elapses from the time when the receiving unit 120 starts a receiving process to the time when the receiving unit 120 acquires information superimposed on a satellite signal. In a case where the receiving unit 120 fails to acquire information superimposed on a satellite signal due to a time-out, the time-out period is equal to the reception duration. In this embodiment, the predetermined period is 24 hours, but is not limited to 24 hours.

Figure 3:
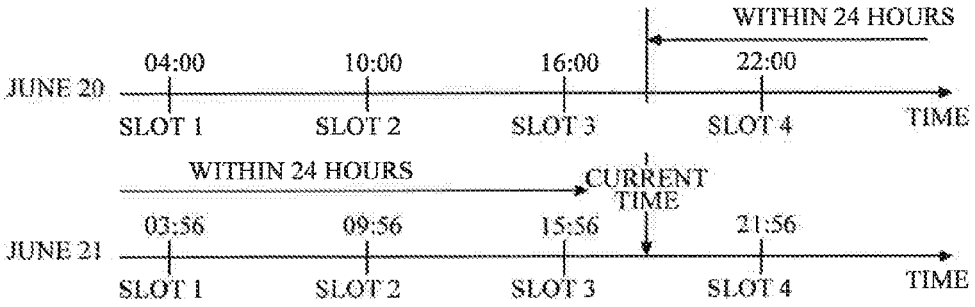
FIG. 3 is a diagram for explaining the total sum (SUM_R) of reception durations.

Referring now to FIG. 3, the process of calculating the total sum (SUM_R) of reception durations is described in detail. For example, the number of slots set in one day is four, the reception start time in slot 1 on June 20 is 04:00, the reception start time in slot 2 on the same day is 10:00, the reception start time in slot 3 on the same day is 16:00, and the reception start time in slot 4 on the same day is 22:00. The current time is the time when the receiving process in slot 3 on June 21 is ended. In this case, the control unit 180 calculates SUM_R, which is the total sum of the reception durations in slots 1 through 3 on June 21 and the reception duration in slot 4 on June 20. In a case where each receiving process ends in a short time, and a receiving slot in the same slot is performed twice within 24 hours, the latter reception duration is selected. In a case where a time-out occurs during a receiving process, the time-out period set in the slot is regarded as the reception duration.

After calculating the total sum of reception durations, the control unit 180 refers to the reception frequency setting table stored in the memory 170, and sets a reception frequency. FIG. 4 shows an example of the reception frequency setting table. According to the example of the reception frequency setting table shown in FIG. 4, if the total sum of reception durations is shorter than five minutes, the number of satellite signal receiving processes is set at four in one day. In a case where the total sum of reception durations is not shorter than five minutes but is shorter than 15 minutes, the number of satellite signal receiving processes is set at one a day. In a case where the total sum of reception durations is not shorter than 15 minutes but is shorter than 25 minutes, the number of satellite signal receiving processes is set at one in two days. In a case where the total sum of reception durations is not shorter than 25 minutes and not longer than 35 minutes, the number of satellite signal receiving processes is set at one in three days. That is, according to the reception frequency setting table, the number of receiving processes to be performed in one day becomes smaller as the total sum of the reception durations in the respective slots becomes larger.

After setting a reception frequency, the control unit 180 sets a time-out period. First, the control unit 180 calculates the value of SUM_T according to the equation (1) shown below.

$$\text{SUM_T} = \sum_{n=1}^{4} (RCVP(n) + TOF(n) \times 2) \tag{1}$$

In the above equation (1), RCVP(n) represents the reception duration in each slot within 24 hours from the end of a receiving process, and n represents the identification number for identifying each slot. Since the number of slots is set at four in the equation (1), n varies from 1 to 4, but can be changed in accordance with the number of slots. TOF represents a time-out flag. In a case where a receiving process is not completed after the time-out period has passed, "1" is recorded as the time-out flag. In a case where a receiving process is completed without a time-out, "0" is recorded as the time-out flag.

Based on the value of SUM_T calculated according to the equation (1) and the above described reception frequency, the control unit 180 sets a time-out period by referring to the time-out setting table shown in FIG. 5. FIG. 5 shows an example of the time-out setting table. For example, in a case where the value of SUM_T is less than five minutes, and the reception frequency is four times a day, the time-out period is three minutes. In a case where the value of SUM_T is less than five minutes, and the reception frequency is once a day, the time-out period is 15 minutes. In a case where the value of SUM_T is less than five minutes, and the reception frequency is once in two days, the time-out period is 25 minutes. In a case where the value of SUM_T is less than five minutes, and the reception frequency is once in three days, the time-out period is 35 minutes. In cases where the value of SUM_T is not less than five minutes and not more than 10 minutes, where the value of SUM_T is not less than 10 minutes and not more than 15 minutes, and where the value of SUM_T is not less than 15 minutes and not more than 35 minutes, the time-out period is set in the same manner as above. According to the time-out setting table shown in FIG. 5, the reception duration of one receiving process becomes longer as the total sum of reception durations in the respective slots becomes larger.

In a case where a receiving process of the receiving unit 120 is not ended after the set time-out period has passed, the control unit 180 records a time-out flag of "1" in the corresponding slot, and adds a predetermined period to the time-out period. For example, the control unit 180 sets a new time-out period by adding two minutes to the time-out period. In this embodiment, the maximum value of the time-out period is 35 minutes. Therefore, if the time-out period is set at 35 minutes, the predetermined period is not added to the time-out period.

Figure 6:
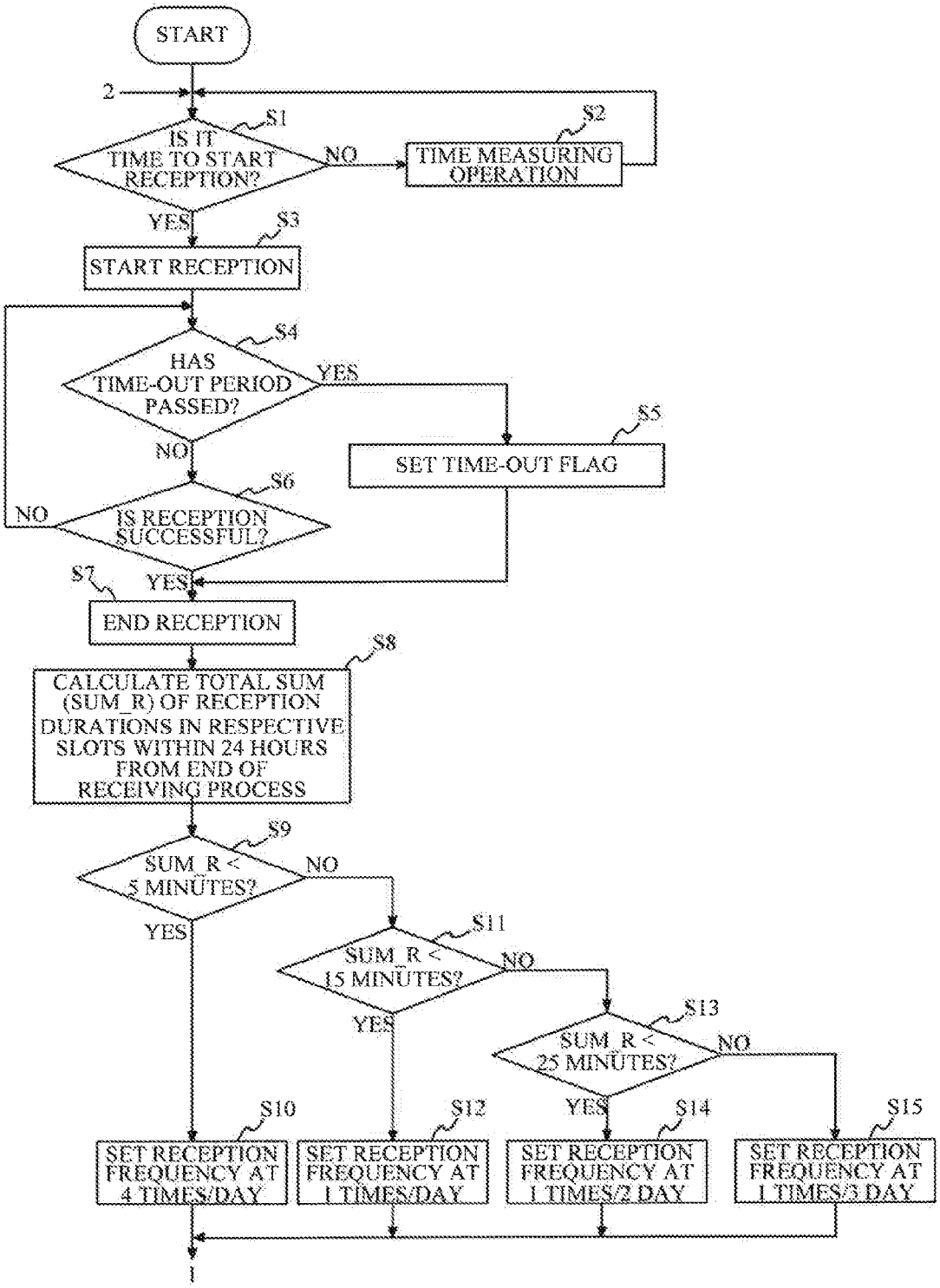
FIG. 6 is a flowchart showing an example of control procedures of the control unit.
Figure 7:
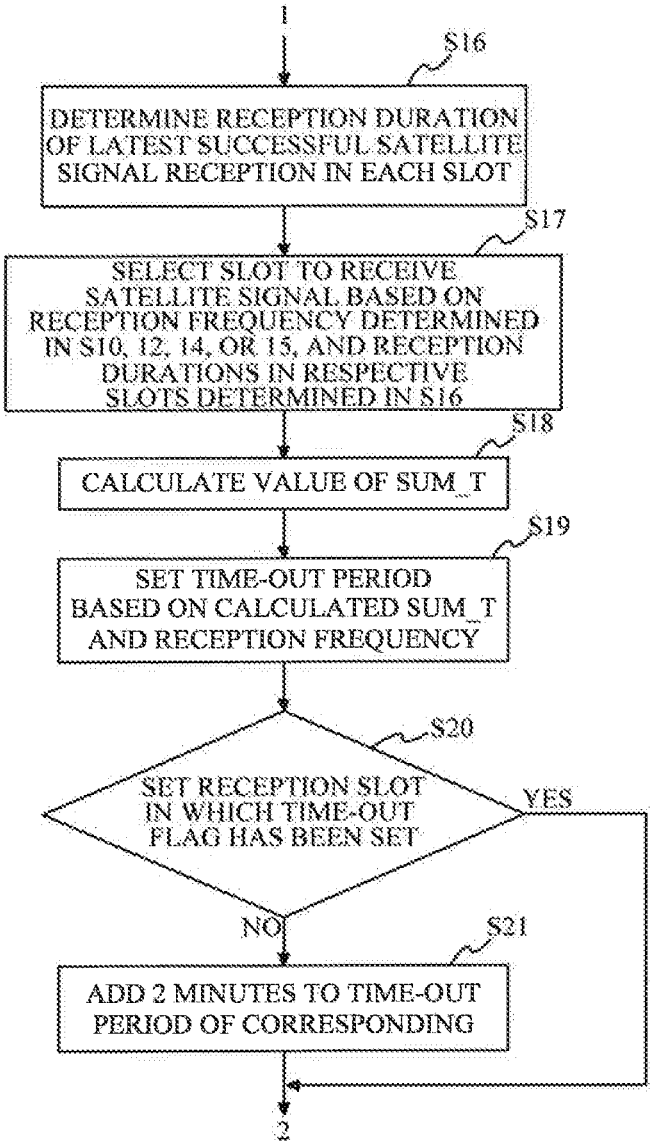
FIG. 7 is a flowchart showing the example of the control procedures continuing from the flowchart shown in FIG. 6.

Referring now to the flowchart shown in FIGS. 6 and 7, the control procedures of the control unit 180 are described.

First, the control unit 180 determines whether it is a time to start satellite signal reception (step S1). If the control unit 180 determines that it is not a reception start time (step S1: NO), the control unit 180 performs a regular time measuring operation (step S2). If the control unit 180 determines that it is a reception start time (step S1: YES), the control unit 180 causes the receiving unit driving unit 150 to activate the receiving unit 120, and causes the receiving unit 120 to start a receiving process (step S3). The control unit 180 then determines whether the period of time elapsing from the receiving process start exceeds the time-out period (step S4). If the period of time elapsing from the receiving process start exceeds the time-out period (step S4: YES), the control unit 180 records "1" in the time-out flag (step S5), and ends the receiving process (step S7). If the period of time elapsing from the receiving process start does not exceed the time-out period (step S4: NO), the control unit 180 determines whether a satellite signal has been successfully received (step S6). If a satellite signal has been successfully received (step S6: YES), the control unit 180 causes the receiving unit driving unit 150 to stop the operation of the receiving unit 120, and ends the receiving process (step S7). If any satellite signal has not been received (step S6: NO), the control unit 180 returns to step S4 and carries out the procedures that follow.

After the receiving process is ended (step S7), the control unit 180 calculates the total sum (SUM_R) of the reception durations in the respective slots within 24 hours from the end of the receiving process (step S8). After calculating the total sum (SUM_R) of the reception durations, the control unit 180 determines whether the total sum (SUM_R) of the reception durations is shorter than five minutes (step S9). If the total sum (SUM_R) of the reception durations is shorter than five minutes (step S9: YES), the control unit 180 sets the reception frequency at four times a day (step S10). If the total sum (SUM_R) of the reception durations is equal to or longer than five minutes (step S9: NO), the control unit 180 determines whether the total sum (SUM_R) of the reception durations is shorter than 15 minutes (step S11). If the total sum (SUM_R) of the reception durations is shorter than 15 minutes (step S11: YES), the control unit 180 sets the reception frequency at once a day (step S12). If the total sum (SUM_R) of the reception durations is equal to or longer than 15 minutes (step S11: NO), the control unit 180 determines whether the total sum (SUM_R) of the reception durations is shorter than 25 minutes (step S13). If the total sum (SUM_R) of the reception durations is shorter than 25 minutes (step S13: YES), the control unit 180 sets the reception frequency at once in two days (step S14). If the total sum (SUM_R) of the reception durations is equal to or longer than 25 minutes (step S13: NO), the control unit 180 sets the reception frequency at once in three days (step S15).

Referring now to the flowchart shown in FIG. 7, the description of the control flow of the control unit 180 is continued.

Figure 8:
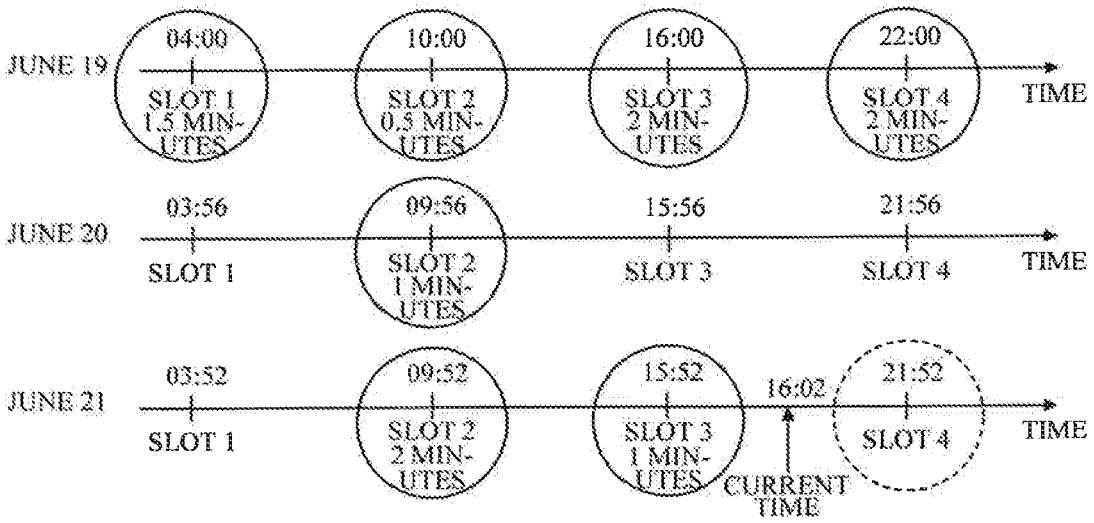
FIG. 8 is a diagram for explaining the reception durations of the latest successful satellite signal receiving processes.

After setting the reception frequency, the control unit 180 determines the reception duration of the last successful satellite signal reception in each slot (step S16). Referring now to FIG. 8, the processing in step S16 is described. FIG. 8 shows the reception states of the respective slots during the three days: June 19, 20, and 21. The circled slots are the slots in which satellite signals were successfully received. In each of the slots in which reception was successful, a reception start time, a slot number, and a reception duration are shown. For example, in slot 1 of June 19, the reception start time is 04:00, and the reception duration is one and a half minutes. The duration period of the latest successful satellite reception is determined based on the current time in each slot by a process of determining the reception duration of the receiving process with the latest reception start time among the receiving processes that have succeeded in receiving a satellite signal. In a case where the current time is 16:02 on June 21, for example, the reception. duration of the latest satellite signal reception in slot 1 is one and a half minutes of June 19. The reception duration of the latest satellite signal reception in slot 2 is two minutes of June 21. The reception duration of the latest satellite reception in slot 3 is one minute of June 21. The reception duration of the latest satellite signal reception in slot 4 is two minutes of June 19.

The control unit 180 then selects the slot to receive a satellite signal based on the reception. frequency determined in step S10, 12, 14, or 15, and the reception durations in the respective slots calculated in step S16 (step S17). For example, in a case where once a day, once in two days, or once in three days is set as the reception frequency, the control unit 180 selects the reception slot that is the slot having the shortest reception duration among the reception durations in the respective slots determined in step S16.

The control unit 180 then calculates the value of SUM_T according to the above equation (1) (step S18). After calculating the value of SUM_T, the control unit 180 refers to the time-out setting table shown in FIG. 5, and sets the time-out period in the reception slot based on the calculated value of SUM_T and the reception frequency (step S19). After setting the time-out period in the reception slot, the control unit 180 determines whether this reception slot is the slot in which the time-out flag has been set in step S5 (step S20). If the reception slot is the slot in which the time-out flag has been set (step S20: YES), the control unit 180 sets a new time-out period by adding two minutes to the time-out period set in the corresponding slot (step S21). For example, in a case where the time-out period determined according to the time-out setting table shown in FIG. 5 is 25 minutes, the time-out period is set at 27 minutes. In a case where the reception slot is not the slot in which the time-out flag has been set (step S20: NO), or when completing the processing in step S21, the control unit 180 returns to the processing in step S1.

Referring to FIGS. 4 and 8, the processing in step S17 is now described. If SUM_R at the end of the receiving operation at 22:00 on June 19 is six minutes, and the slot having the shortest reception duration in the reception history is slot 2, the control unit 180 sets the reception frequency at once a day by referring to the reception frequency setting table shown in FIG. 4. The control unit 180 also selects slot 2 having the shortest reception duration as the next reception slot by referring to the reception history. Using slot 2, the control unit 180 starts a receiving operation 23 hours 56 minutes after 10:00, which is the reception start time in slot 2 on June 19.

FIG. 8 indicates that a receiving operation started in slot 2 at 09:56 on June 20. At this point, SUM_R is five minutes, and the control unit 180 again sets the reception frequency at once a day by referring to the reception frequency setting table shown in FIG. 4. Based on the latest reception durations in the respective slots, the reception duration of one minute from 9:56 is the shortest in this case. Therefore, slot 2 is again selected as the next reception slot. The control unit 180 starts a receiving operation 23 hours 56 minutes after 09:56, which is the reception start time in slot 2 on June 20.

FIG. 3 indicates that a receiving operation started in slot 2 at 09:52 on June 21. At this point, SUM_R is two minutes, and therefore, the control unit 180 sets the reception frequency at four times a day by referring to the reception frequency setting table shown in FIG. 4. Since the reception frequency is four times a day in this case, the control unit 180 selects slot 3 as the next reception slot.

As described in detail so far, this embodiment sets a satellite signal reception frequency and an upper limit period of a receiving process in accordance with the total sum of the duration periods of the receiving processes performed in a predetermined period of time. Accordingly, an optimum reception frequency and an optimum upper period can be set in accordance with the environment to receive satellite signals.

As the total sum of the durations of receiving processes becomes larger, the number of times of a receiving process to be performed becomes smaller, and the upper limit period of a receiving process becomes longer. Therefore, in a case where the environment to receive satellite signals is poor, the number of times a receiving process is to be performed is reduced, and the upper limit period of each receiving process is made longer. Accordingly, battery power consumption can be reduced, and the operating time of the radio clock can be prolonged.

Also, in a case where a satellite signal receiving process is not successfully performed even after the upper limit period has passed, a new upper limit period is set by adding a predetermined period to the upper limit period. In this manner, the probability of a successful receiving process can be increased.

The above described embodiment is a preferred embodiment of the present invention. However, the present invention is not limited to the embodiment, and various changes and modifications may be made to it without departing from the scope of the invention.

What is claimed is:

1. A. radio clock comprising:

an antenna configured to receive a satellite signal transmitted from a GPS satellite;

a receiving unit configured to perform a receiving process to acquire information contained in the satellite signal received by the antenna within a predetermined upper limit period; and a control unit configured to change the number of receiving processes to be performed in a predetermined period and change the upper limit period in accordance with a total sum of durations of the receiving processes performed in the predetermined period.

2. The radio clock of claim 1, wherein the control unit performs setting so that the number of the receiving processes becomes smaller as the total sum of the durations of the receiving processes becomes larger, and performs setting so that the upper limit period becomes longer as the total sum of the durations of the receiving processes becomes larger.

3. The radio clock of claim. 1, wherein, when the receiving unit is yet to acquire the information after the upper limit period has passed, the control unit sets a new upper limit period by adding a predetermined period to the upper limit period.

4. The radio clock of claim 1, wherein the control unit changes a start time of the receiving process in accordance with a time difference in an orbital cycle of the GPS satellite with respect to the earth.

5. The radio clock of claim 1, wherein, when connection of the radio clock to a commercial power source is detected, the control unit makes the number of the receiving processes larger and the upper limit period longer than in a case where the radio clock is driven by a battery.

* * * * *